US006412903B1

(12) United States Patent
Lee et al.

(10) Patent No.: US 6,412,903 B1
(45) Date of Patent: Jul. 2, 2002

(54) METHOD OF CORRECTING A PRINT ERROR CAUSED BY MISALIGNMENT BETWEEN CHIPS MOUNTED ON AN ARRAY HEAD OF AN INKJET PRINTER

(75) Inventors: Sung-hee Lee; Kvu-ho Shin, both of Suwon; Seong-taek Lim, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/964,513

(22) Filed: Sep. 28, 2001

(30) Foreign Application Priority Data

Sep. 30, 2000 (KR) ..... 2000-57689

(51) Int. Cl.[7] ..... B41J 29/393
(52) U.S. Cl. ..... 347/19; 347/13
(58) Field of Search ..... 347/12, 13, 19, 347/40, 42

(56) References Cited

U.S. PATENT DOCUMENTS 4,818,129 A * 4/1989 Tanuma et al. ..... 400/323
5,534,895 A * 7/1996 Lindenfelser et al. ..... 347/19
5,539,434 A * 7/1996 Fuse ..... 347/19
5,835,108 A * 11/1998 Beauchamp et al. ..... 347/19
5,964,032 A * 10/1999 Orikasa et al. ..... 29/890.1
6,312,099 B1 * 11/2001 Hawkin et al. ..... 347/42

* cited by examiner

*Primary Examiner*—John Barlow
*Assistant Examiner*—Blaise L Mouttet
(74) *Attorney, Agent, or Firm*—Staas & Halsey LLP

(57) ABSTRACT

A method of correcting a print error caused due to a misalignment between chips mounted on an array head of an inkjet printer. The method includes calculating an acceptable limit of a rotation angle of the chips with respect to reference positions, based upon a range that does not cause a white band to form on a printed image; determining whether the rotation angle of each chip is within the acceptable limit or not; correcting a machine error of each chip if it is determined that the rotation angle of each chip is not within the acceptable limit; if the rotation angle of each chip is within the acceptable limit, adding a plurality of nozzles on at least one end of each chip, determining which of the added nozzles to use based on a predetermined trial printing pattern, and correcting a print error in a horizontal direction that is caused due to a misalignment in the horizontal direction; and correcting a print error in a vertical direction due to a misalignment between the chips in a vertical direction by determining a reference time for voltage pulse application to a heater disposed on a nozzle of the array head based on the predetermined trial printing pattern, by variably determining voltage pulse application time, thereby adjusting a time interval for an ink ejection from the respective chips.

18 Claims, 18 Drawing Sheets

| USER SELECTION BUTTON | BETWEEN CHIPS 1 AND 2 | BETWEEN CHIPS 2 AND 3 | BETWEEN CHIPS 3 AND 4 |
|---|---|---|---|
| CASE I | ○ | ○ | ● |
| CASE II | ○ | ○ | ○ |
| CASE III | ● | ○ | ○ |
| CASE IV | ○ | ● | ○ |

METHOD OF CORRECTING A PRINT ERROR CAUSED BY MISALIGNMENT BETWEEN CHIPS MOUNTED ON AN ARRAY HEAD OF AN INKJET PRINTER

CROSS-REFERENCE TO RELATED APPLICATIONS

This application claims the benefit of Korean Application No. 2000-57689, filed Sep. 30, 2000, in the Korean Industrial Property Office, the disclosure of which is incorporated herein by reference.

BACKGROUND OF THE INVENTION

1. Field of the Invention

The present invention relates to a method of correcting a print error of an inkjet printer, and more particularly, to a method of correcting a print error caused by misalignment between a plurality of chip,s mounted on an array head of the inkjet printer.

2. Description of the Related Art

Generally, compared to a shuttle type inkjet printer that conveys one chip for printing, an array head type inkjet printer uses a plurality of chips to print at a higher speed. Although the array head type inkjet printer prints at the higher speed, it also has a higher possibility of having deteriorated print quality even with a minute deviation of the chips from a designated position.

The print quality deterioration will now be described in greater detail with reference to FIGS. 1 through 3. Referring to FIG. 1, an array head 1 of an inkjet printer includes a print bar 10, and a plurality of unit chips 20. Each unit chip 20 has a plurality of nozzles 31 through which ink droplets are ejected. The nozzles 31 form a nozzle group 30. For example, as shown in FIG. 1, there are six nozzle groups 30, each consisting of six nozzles 31 on one unit chip 20.

As shown in FIG. 2A, a line is printed as the ink droplets are ejected onto a printing medium from the first nozzle 31 of the nozzle group 30 of the unit chip 20, and then from the second, and third through sixth nozzles 31, sequentially. A period (T) of a voltage application to heaters (not shown) of the respective nozzles 31 is obtained by the following formula:

$$\tau = U/\underline{c}[d] \qquad \text{Formula 1}$$

where U is a printing medium feeding speed, and c is a vertical distance between two nozzles 31.

As shown in FIG. 3, the unit chips 20 are mounted on the print bar 10, the unit chips 20 are frequently deviated from the ideal position due to a machine error, causing misalignment between the unit chips 20. There are three types of misalignment, i.e., a rotation by tilting (e), a horizontal translation ($\delta_n$) and a vertical translation ($\delta_v$) of the unit chips 20. Only a minute degree of misalignment causes a white band and a dark line to form, thus the print quality deteriorates.

SUMMARY OF THE INVENTION

Accordingly, it is an object of the present invention to provide a method of a print error caused due to misalignment between unit chips, which occurs while mounting a plurality of the unit chips on a print bar of an array head type inkjet printer.

Additional objects and advantages of the invention will be set forth in part in the description which follows and, in part, will be obvious from the description, or may be learned by practice of the invention.

The above and other objects are accomplished by a method of correcting a print error caused due to a misalignment between unit chips mounted on an array head of an inkjet printer in accordance with the present invention, including calculating an acceptable limit of a rotation angle of the unit chips with respect to reference positions, within a range that does not cause a white band to form on a printed image; determining whether the rotation angle of each unit chip is within the acceptable limit or not; correcting a machine error of each unit chip if it is determined that the rotation angle of each unit chip is not within the acceptable limit; if the rotation angle of each unit chip is within the acceptable limit, adding a plurality of nozzles on an end of each unit chip, determining which of the added nozzles to use based on a predetermined trial printing pattern, and correcting a print error in a horizontal direction that is caused due to a misalignment in the horizontal direction; and correcting a print error in a vertical direction that is caused due to a misalignment between the unit chips in the vertical direction by determining a reference time for voltage pulse application to a heater disposed on a nozzle of the array head of the inkjet printer based on the predetermined trial printing pattern, by variably determining voltage pulse application time thereby adjusting a time interval for an ink ejection from the respective unit chips.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
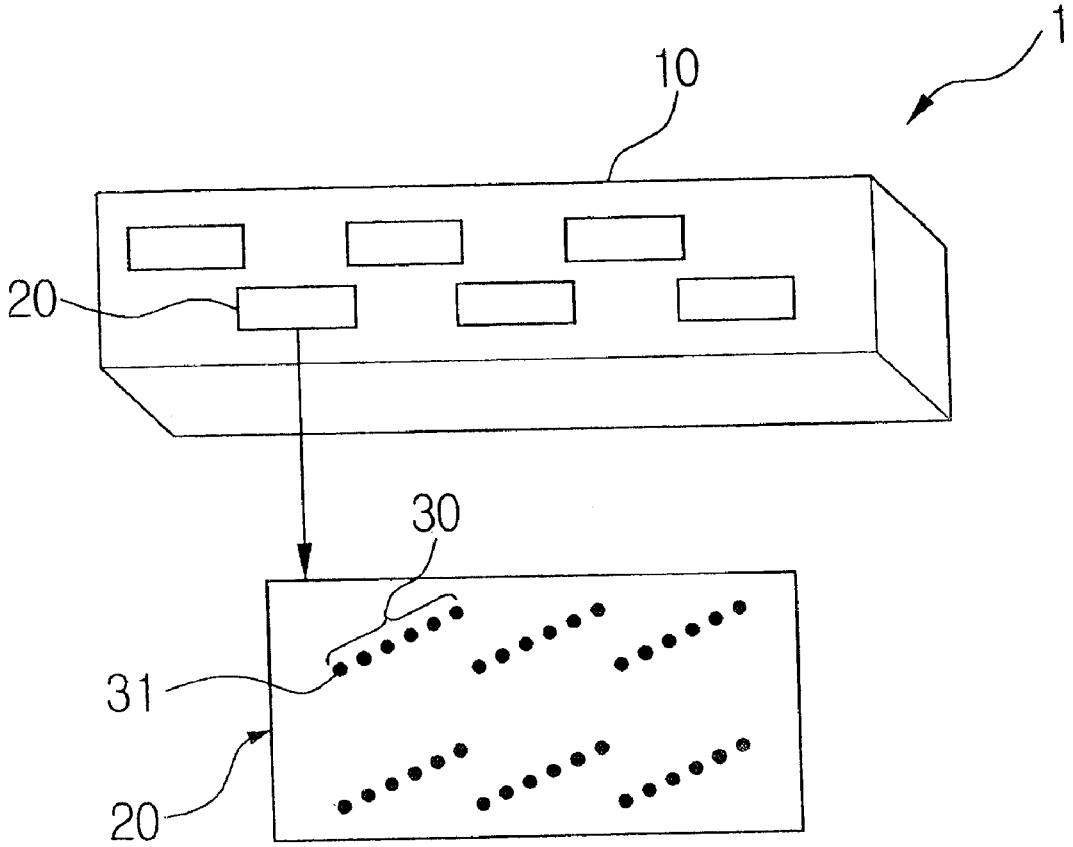
FIG. 1 is a diagram showing in detail a print bar and unit chips mounted on the print bar in an array head of an inkjet printer.
Figure 2A:
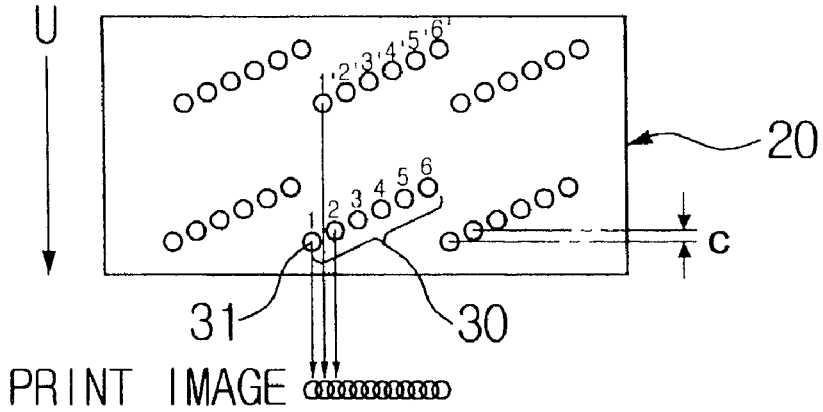
FIG. 2A is a diagram showing a printing method of the unit chips.
Figure 2B:
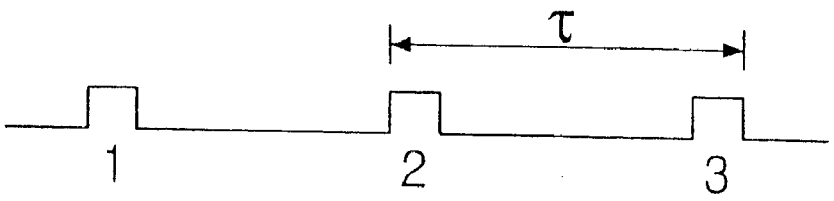
FIG. 2B is a period of the voltage application to a heater according to the printing method.
Figure 3:
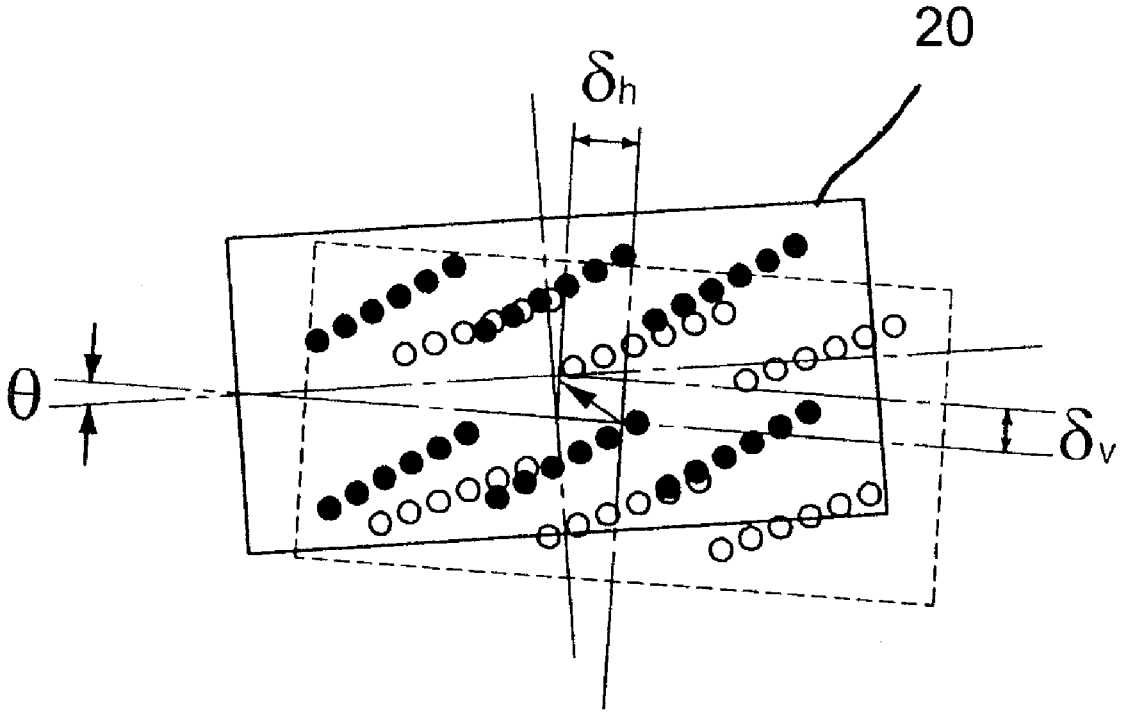
FIG. 3 is a diagram showing modes of misalignment between the unit chips.

Reference will now be made in detail to the present preferred embodiments of the present invention, examples of which are illustrated in the accompanying drawings, wherein like reference numerals refer to like elements throughout.

In correcting the print error caused by three types of misalignment, first, the tilt of the unit chip 20 is corrected. Then, if the tilt of the unit chip 20 falls within an acceptable range, the print error by the horizontal misalignment between the unit chips 20 is corrected, and then the print error caused due to the vertical misalignment between the unit chips 20 is corrected.

Figure 4A:
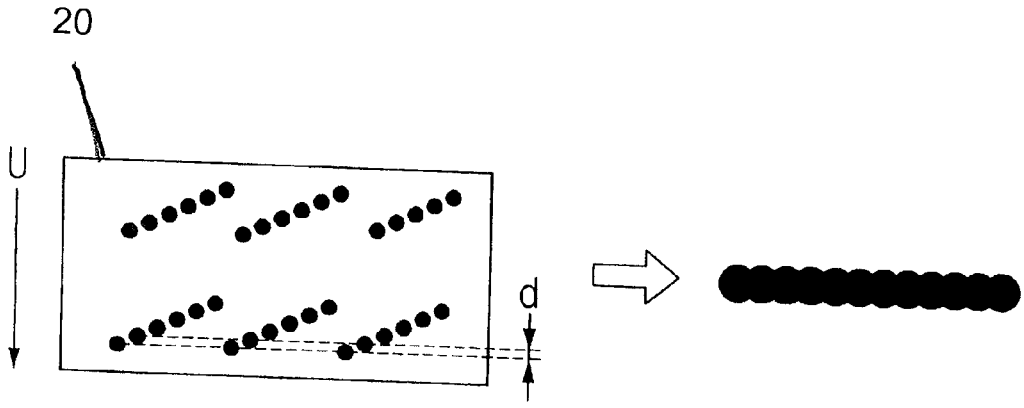
FIG. 4A is a diagram showing an ideal position of the unit chips and the respective printing image printed on the printing medium.
Figure 4B:
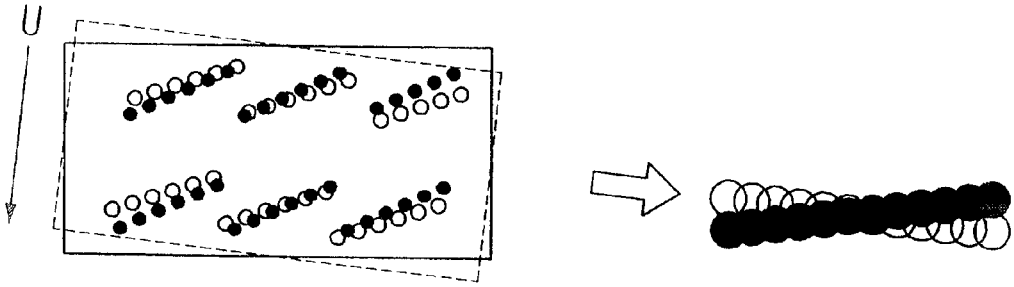
FIG. 4B is a diagram showing the unit chips being tilted, and the respective printing image printed 6n the printing medium.

As shown in FIG. 4A, when the unit chip 20 is mounted at a designated position, the printing image is in perfect form without any skew. The problem is when mounting the unit chip 20 on the print bar 10, due to a machine error, the unit chip 20 may be rotated from the designated position, as shown in FIG. 4B. Accordingly, the printing image is skewed. Such a rotation of the unit chip 20 also causes a white band on the printing image when exceeding a certain limit.

Figure 5:
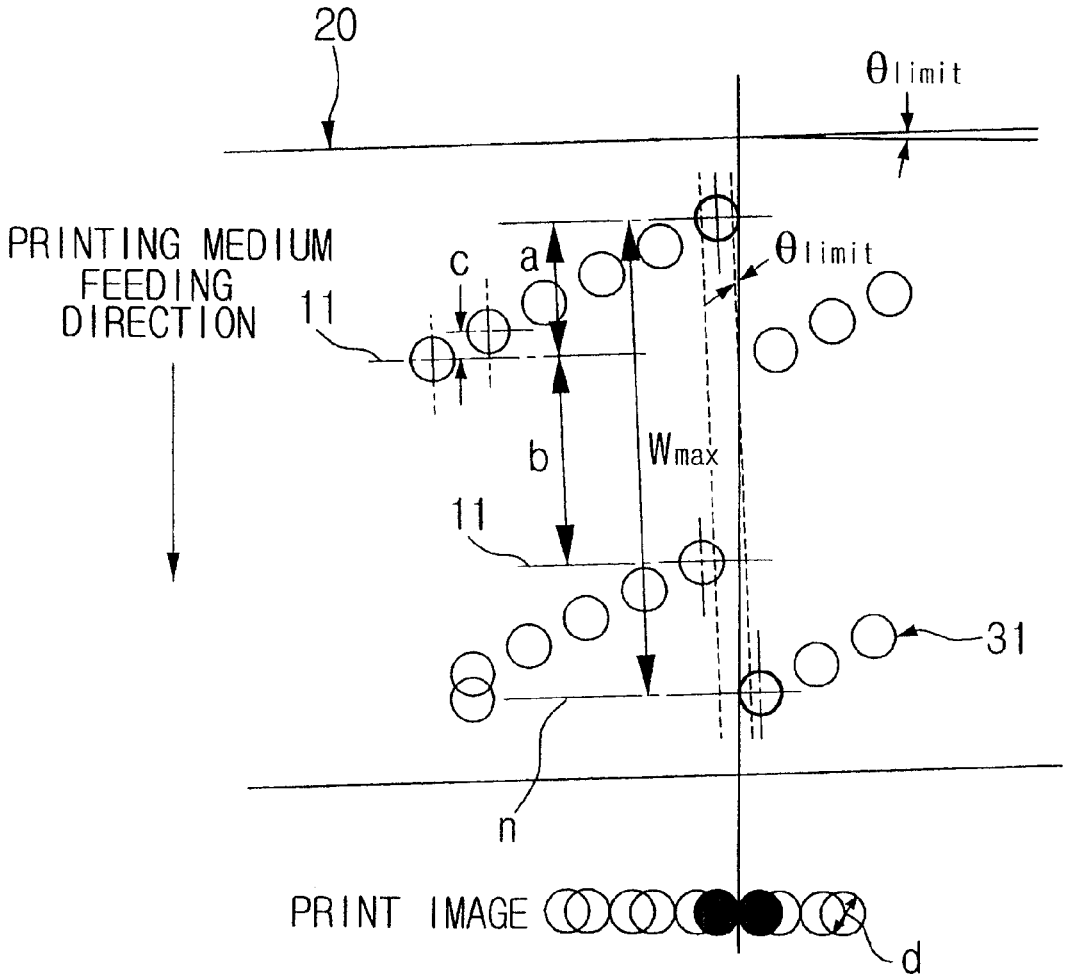
FIG. 5 is a diagram showing a limit being set on the rotation by tilting of the unit chips in accordance with the present invention.

Here, whether the unit chip 20 is turned beyond a certain limit or not, can be determined by checking whether there is a gap between two dots printed by one of the nozzles 31 of one nozzle group 30 and by one of the nozzles 31 of the adjacent nozzle group 30 on the unit chip 20. The two nozzles 31 are those that are most remote from each other in the printing medium feeding direction. The limit of the rotation angle is obtained by the following formula:

$$\theta_{\lim}[\deg] \approx \frac{(d - pel)}{W_{\max}} \times \frac{180}{\pi} \qquad \text{Formula 2}$$

where, as shown in FIG. 5, d is a diameter of the printed dot, pel is a length of the unit chip 20 divided by a number of dots, and $W_{max}$ is a distance between centers of the two nozzles 31 of neighboring nozzle groups 30, the nozzles 31 that are the most remote from each other in the printing medium feeding direction. Specifically, $W_{max}$ can be determined by formula 2':

$$W_{max}=2a+b$$

where a is a vertical distance between the first nozzle 31 and the last nozzle 31 of a certain nozzle group 30, and b is a vertical distance between the first nozzle 31 of the vertically neighboring nozzle group 30 and the last nozzle 31 of the next nozzle group 30. Meanwhile, in FIG. 5, c is a vertical distance between two neighboring nozzles 31 of the same nozzle group.

For example, for a chip 20 having a length of 12.7 mm, when the number of dots is 300, the pel is 42.3 $\mu$m per dot, a is 16.75 $\mu$m, b is 660.5 $\mu$m, c is 0.875 $\mu$m, d is 59.8 $\mu$m and $W_{max}$ is 694 $\mu$m. Substituting pel, d, and $W_{max}$ into formula 2 gives the limit of the rotation angle as 1.4450°.

Figure 6:
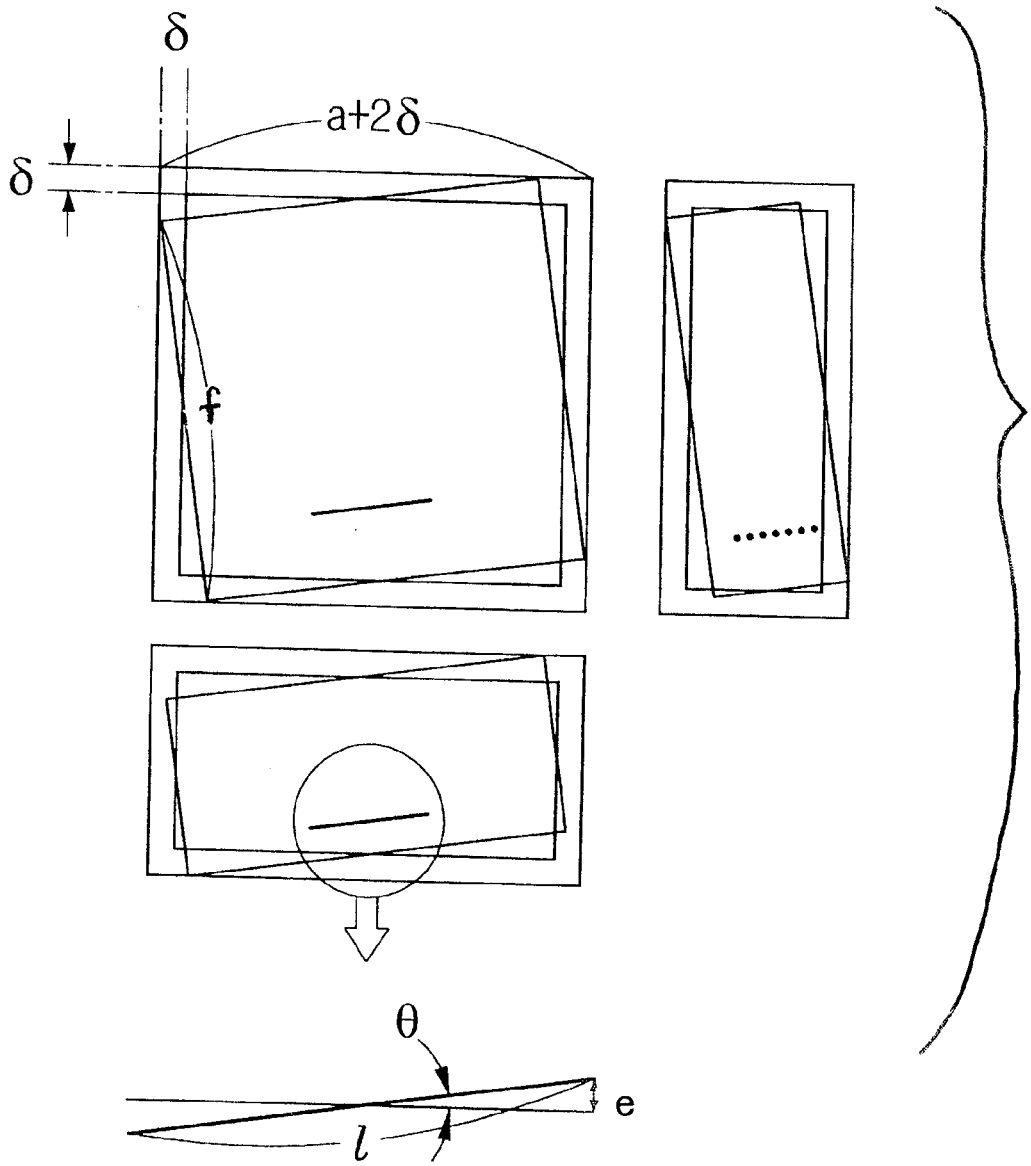
FIG. 6 is a diagram showing a tilting angle of the unit chips caused by a machine error.

The tilt of the unit chip 20 is actually caused due to machine error, and such machine error almost always exists regardless of the fabricating method. Referring to FIG. 6, let us say the machine error is δ, and a longer side of the unit chip 20 is f. The screw rotation angle θ is determined by these two values in accordance with the following formulae 3 and 4:

$$\theta = \sin^{-1}\left[\frac{1}{\sqrt{2}}\left(1 + \frac{2\delta}{f}\right)\right] - \frac{\pi}{4} \qquad \text{Formula 3}$$

$$e = \frac{l}{2}\sin\theta = \frac{l}{2}\sin\left\{\sin^{-1}\left[\frac{1}{\sqrt{2}}\left(1 + \frac{2\delta}{f}\right)\right] - \frac{\pi}{4}\right\} \qquad \text{Formula 4}$$

where l is a length of a printed image, and e is a vertical direction of the printed image by tilting of the unit chip 20.

Figure 7:
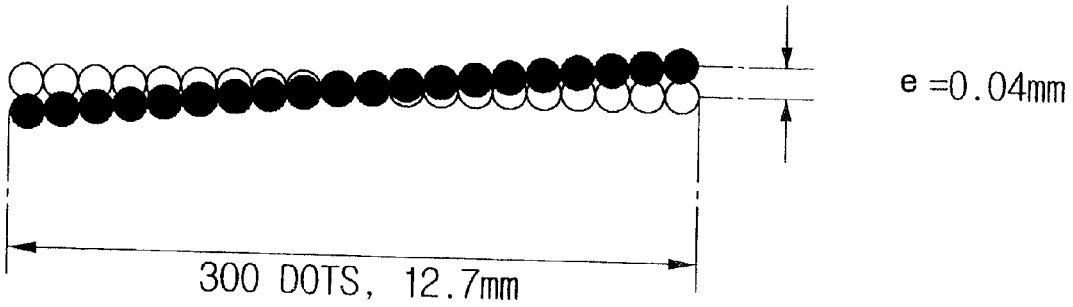
FIG. 7 is a diagram showing a print error caused by tilting of the unit chips when the machine error of the unit chips is 0.04 mm.

For example, when there is 40 $\mu$m of machine error δ in the 12.7 mm unit chip 20 as shown in FIG. 7, according to the formulae 3 and 4, the rotation angle θ of the unit chip 20 by tilting is 0.310°, which is smaller than the reference rotation angle limit ($\theta_{lim}$=1.445°). Accordingly, the: white band is not formed. Furthermore, the vertical direction error e of the printed image is approximately 40 $\mu$m, like the machine error δ. Since the tilt of 40 $\mu$m generated by the 40 $\mu$m of machine error is much smaller than the length (12.7 mm) of the printed image, the skew of the image is barely recognizable to the naked eye.

When the rotation angle caused by tilting is not within the acceptable range, however, the machine error must be corrected during the fabrication process. When the tilt of the unit chip 20 is within the acceptable range, then the print error due to horizontal and vertical misalignment between the unit chips 20 is corrected.

Figure 8:
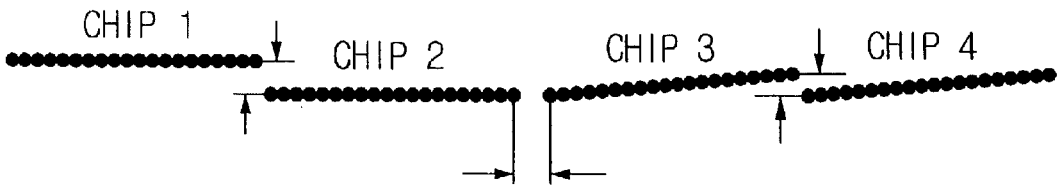
FIG. 8 is a diagram showing the type of print error caused due to the misalignment between the unit chips.

FIG. 8 shows the print error caused by misalignment between the unit chips 20. Here, the print error between the printing images by chips 1 and 2 is caused by the vertical misalignment between the chips, and the print error between the printing images by chips 2 and 3 is caused due to horizontal misalignment between the chips, and the print error between the printing images by chips 3 and 4 is caused by the tilt of the chips.

Accordingly, after the tilt of the unit chips 20 is corrected, by connecting the ends of the printing images of the unit chips 20, the image can be printed perfectly. To achieve this result, the present invention provides a trial printing pattern for the user to select a most desired image with the naked eye, along with a voltage applying method thereof.

Figure 9:
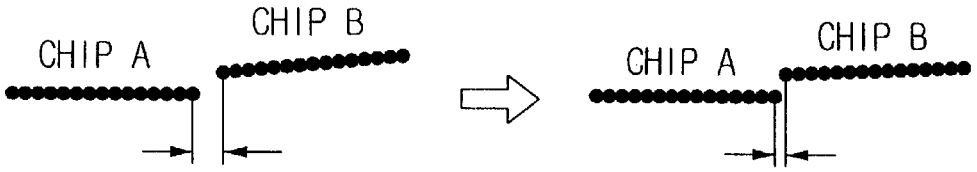
FIG. 9 is a diagram showing a print error caused by a horizontal misalignment between the unit chips, and correction thereof.
Figure 10:
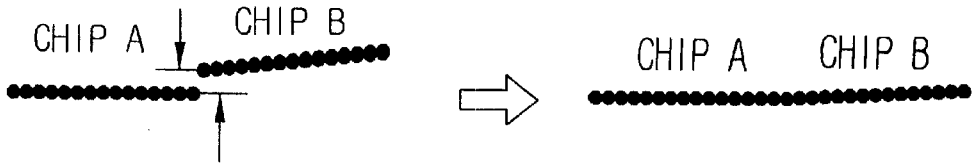
FIG. 10 is a diagram showing a print error caused by a vertical misalignment between the unit chips, and correction thereof.

In order to correct the print error caused by the misalignment between the unit chips 20, first, the horizontal print error is corrected (see FIG. 9), and then the vertical print error is corrected (see FIG. 10).

First, referring to FIGS. 11 and 12, the method of correcting the horizontal print error will be described. The horizontal print error due to horizontal misalignment between the unit chips 20 is corrected by adding a plurality of nozzles on one end of each unit chip 20, and then determining which of the added nozzles to use based on a predetermined trial printing pattern.

Figure 11:
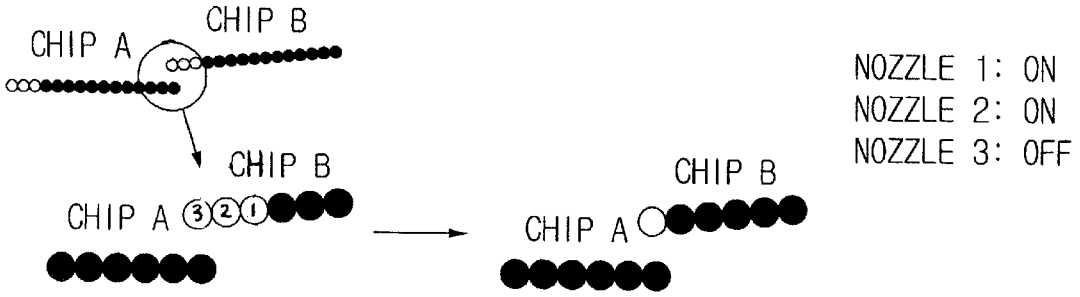
FIG. 11 is a diagram showing the print error caused by the horizontal misalignment between the unit chips being corrected in accordance with the present invention.
Figures 12A, 12B:
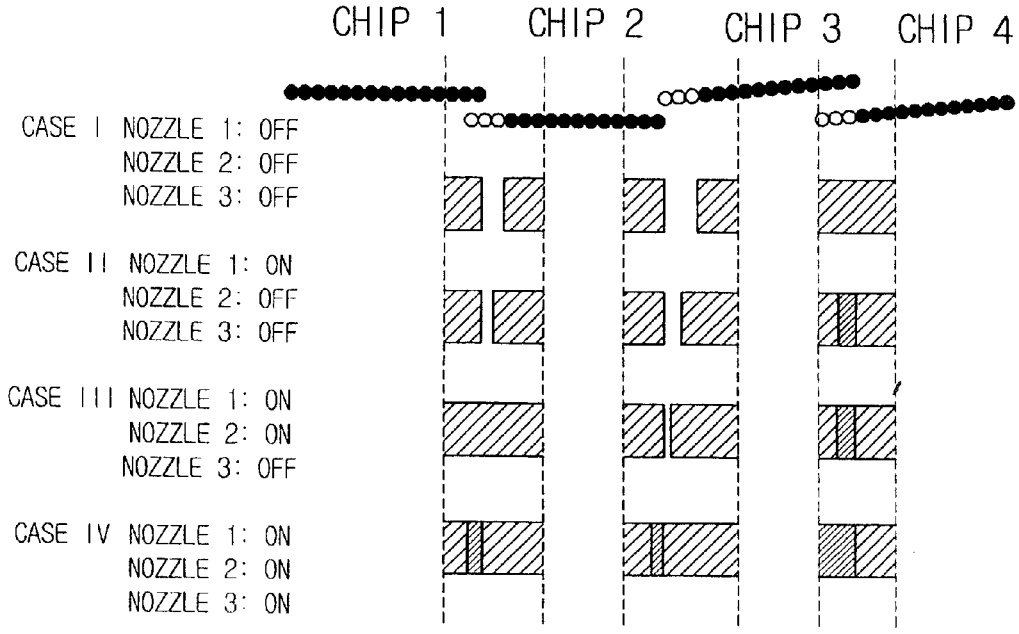
FIG. 12A is a diagram showing the print error caused by the vertical misalignment of the unit chips, being corrected in accordance with the print error correcting method of the present invention.
FIG. 12B is a diagram of selected trial printing patterns for the corrected unit chips of FIG. 12A.

In FIG. 11, three nozzles are added to one end of chips A and B. The number of the added nozzles is determined by the machine error. For an easier understanding, FIGS. 11 and 12A show dots printed by the existing nozzles and the dots to be printed by the added nozzles. The additional nozzles are added to the most external nozzle groups 30 among the existing nozzle groups 30 shown in FIG. 1 in the horizontal direction. The black dots are those that are printed by the existing nozzles 31, while white dots are those that will be printed by the additional nozzles.

When three nozzles are added to the chip B, as shown in FIG. 11, the nozzles ① and ② are in an "on" state, while the nozzle ③ is in an "off" state to correct the horizontal print error corresponding to approximately two dots.

When three nozzles are added to the plurality of unit chips 20, respectively, as shown in FIG. 12A, the trial printing pattern is used. The trial printing pattern shows the printing results of the cases when the printing is performed by operating the newly added nozzles sequentially from the inside to the outside. More specifically, the trial printing pattern shows a thick strip that is printed by printing several lines consecutively at the area where the unit chips 20 are connected to other unit chips 20.

The user selects the printed pattern that does not have a white band or a dark line. In the trial printing pattern of FIG. 12B, the third case is selected between chips 1 and 2, in which the added nozzles ① and ② are in an "on" state, and the added nozzle ③ is in an "off" state, and the fourth case is selected between chips 2 and 3, in which the added nozzles ① ② ③ are in an "on" state, and the first case is selected between chips 3 and 4, in which the nozzles ① ② ③ are in an "off" state. By doing so, the horizontal print error can be adjusted most appropriately.

Figure 13:
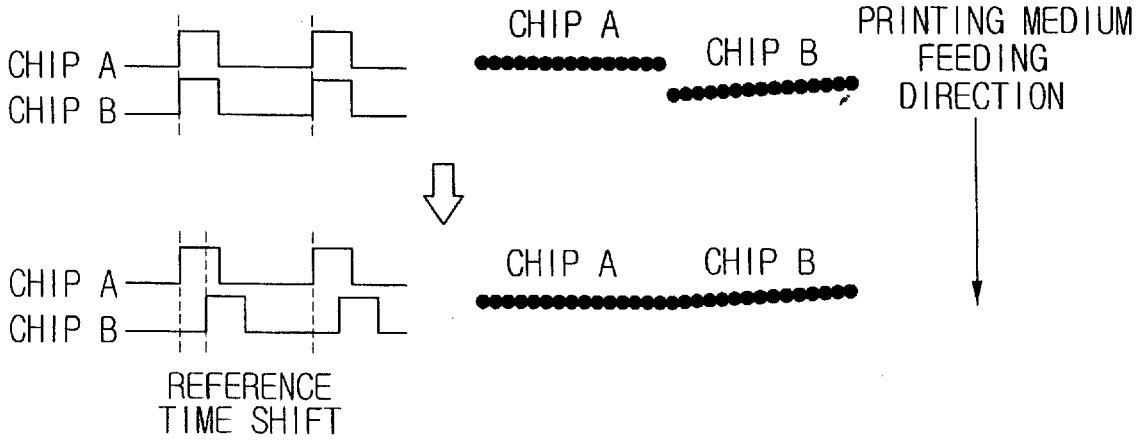
FIG. 13 is a diagram showing the print error caused by the vertical misalignment between the unit chips being corrected in accordance with the present invention.

Next, referring to FIGS. 13 through 19, a method of correcting a vertical print error will be described. The vertical print error caused by vertical misalignment between the unit chips 20 can be corrected by adjusting reference time intervals for ink ejection to the respective chips. This can be achieved by shifting the reference time for voltage pulse application to the heaters of the nozzles 31. As shown in FIG. 13, the vertical distance between chips A and B can be corrected by delaying the time to apply the voltage pulse to chip B by a predetermined time.

Figure 14:
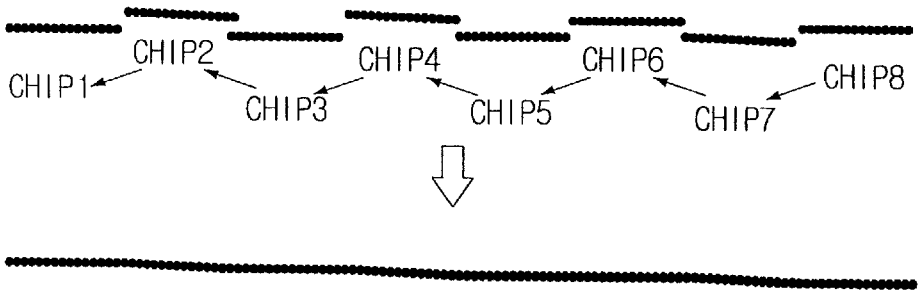
FIG. 14 is a diagram showing the print error caused by the vertical misalignment between the unit chips being corrected in accordance with the present invention.

If there are a plurality of unit chips 20, error is corrected just by setting a delay time between the respectively neighboring unit chips 20. Accordingly, the delay time between the neighboring unit chips 20 is set. With a timing of a certain unit chip 20 as a reference, a timing chart can be obtained by which all of the unit chips 20 can be aligned. FIG. 14 shows the temporal relation between unit chips 20. For an easier reference, let us say the chip at the extreme left-hand side is at the reference time. By setting the relative timing between chips 1 and 2, 2 and 3, 3 and 4, . . . , and 7 and 8, the vertical print error between all of the unit chips 20 can be corrected.

Figure 15A:
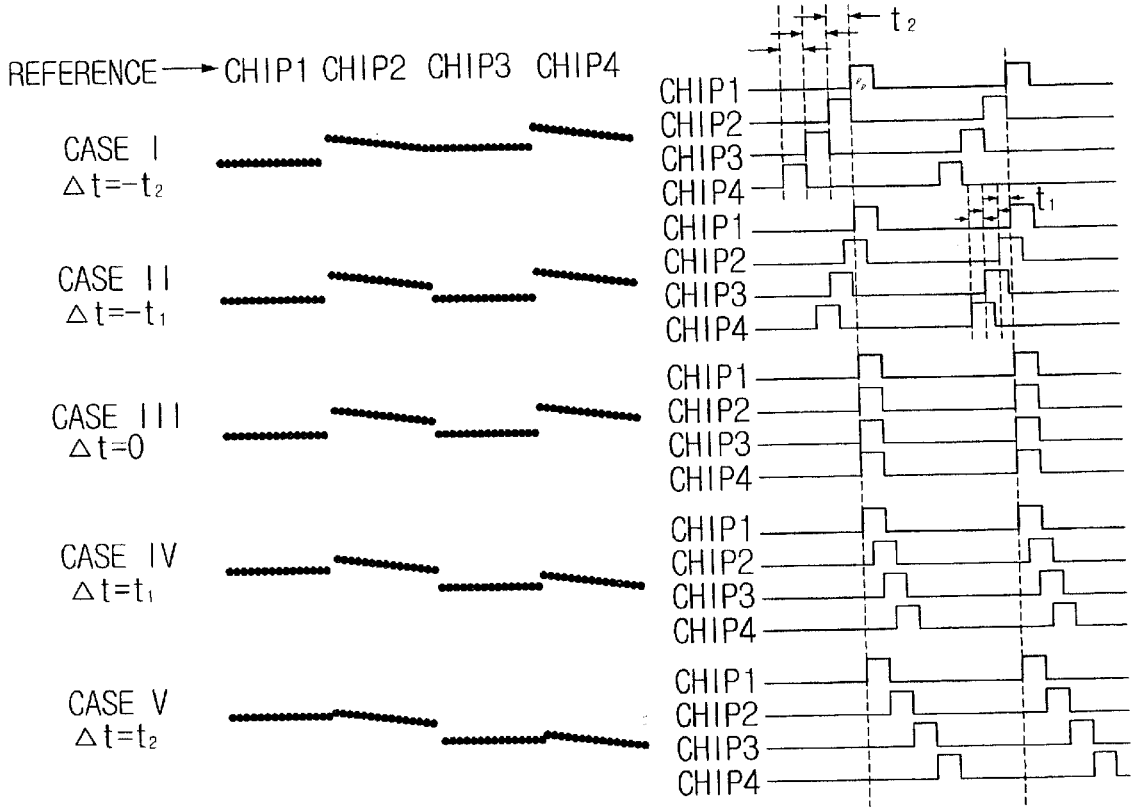
FIG. 15A is a timing chart of a voltage application to a heater in accordance with the present invention.

When there are a plurality of unit chips 20, it is more efficient to set the time intervals of the ink ejections from the respective unit chips 20 based on a predetermined trial printing pattern. FIG. 15A shows a timing chart of the voltage pulse application to heaters according to the trial printing pattern of four chips. The time intervals can be divided into several sections, and FIG. 15A shows the trial printing pattern of lines printed in five cases ($-t_2$, $-t_1$, 0, $t_1$, $t_2$) of two times ($t_1$ and $t_2$).

Figure 15B:
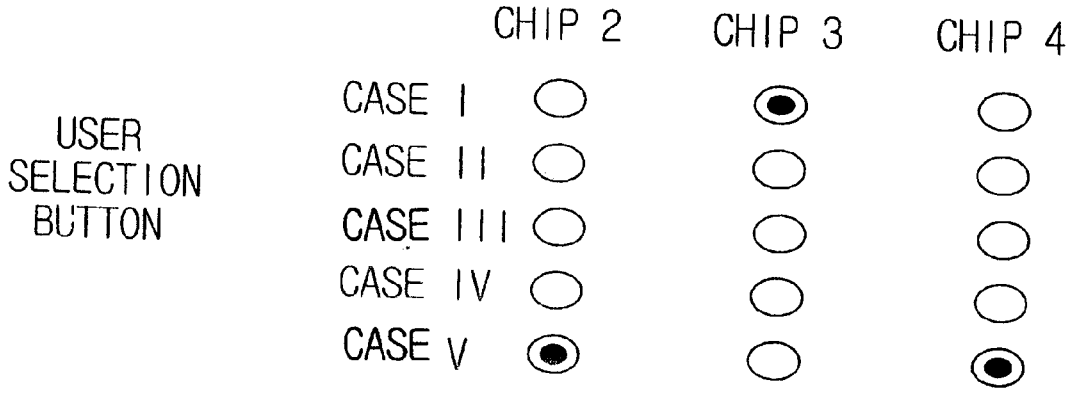
FIG. 15B is a diagram of the selected trial printing patterns of FIG. 15A.

The user checks the patterns as printed, and selects the case that has the printing in which the neighboring unit chips 20 are connected most appropriately. For example, as shown in FIG. 15B, the user selects the fifth case in which the time interval ($\Delta t$) with respect to chip 2 is $t_2$, selects the first case in which the time interval ($\Delta t$) with respect to chip 3 is $-t_2$, and selects the fifth case in which the time interval ($\Delta t$) with respect to chip 4 is $t_2$, thereby correcting the vertical print error most properly.

Setting the number and value of the sections of the time interval depends on the machine error of the unit chip 20 and also on the degree of vertical misalignment between the unit chips 20. The print error value of the vertical misalignment is based on a random process and a gaussian distribution.

Figure 16:
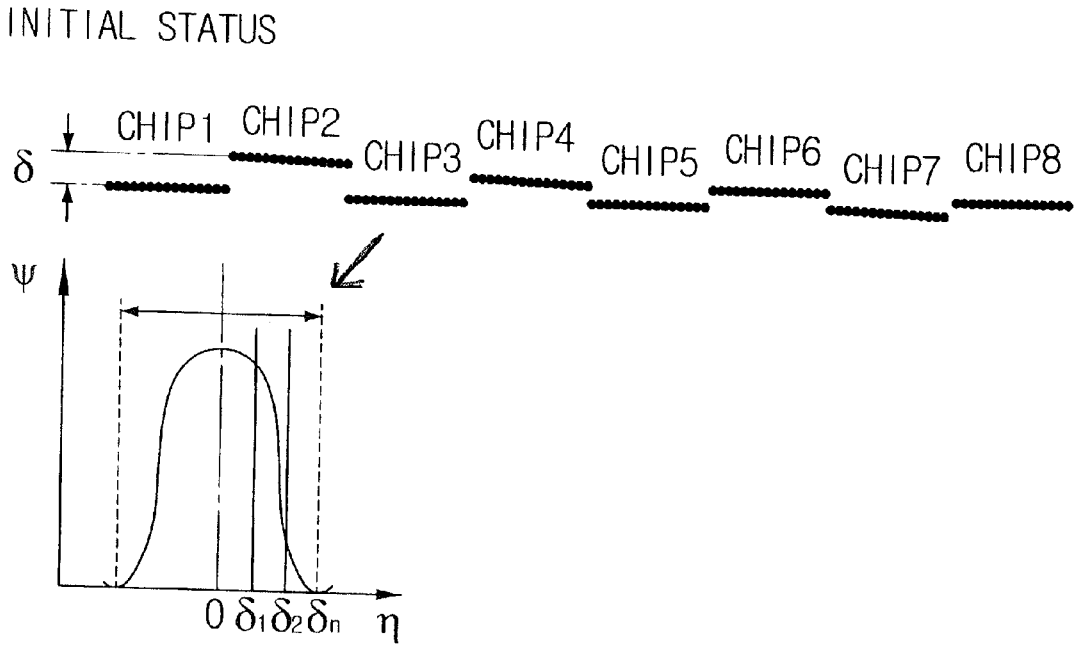
FIG. 16 is a graph showing the unit chips being uniformly set.

A method of setting a uniform time interval with a gradient will now be described. According to a method of setting uniform time intervals, uniform time intervals are set within a possible error range, irrespective of the probability distribution of the gaussian distribution. In FIG. 16, a horizontal axis $\eta$ is a vertical print error by the vertical misalignment between the unit chips 20, and a vertical axis $\Psi$ is a gauss probability function. Here, since $\delta-\delta_2=\delta_2-\delta_1=\delta_1-0$, $$t^1\left(=\frac{\delta 1}{U}\right)=t_2-t_1\left(=\frac{\delta_2-\delta_1}{U}\right)$$

(t: time interval, $\delta$: print error caused by vertical misalignment, U: printing medium feeding speed).

Figure 17A:
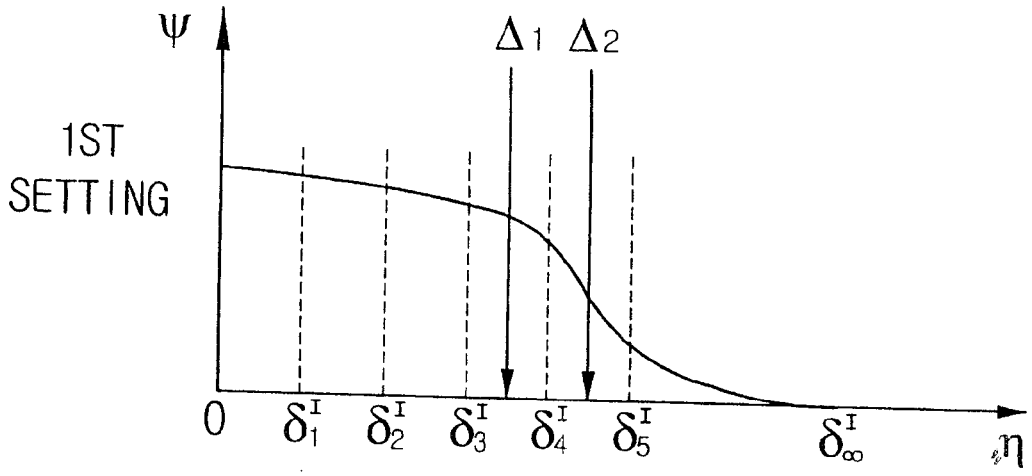
FIG. 17A is a graph showing multi-step correction in uniformly setting a reference time interval between the unit chips using a first setting.
Figure 17B:
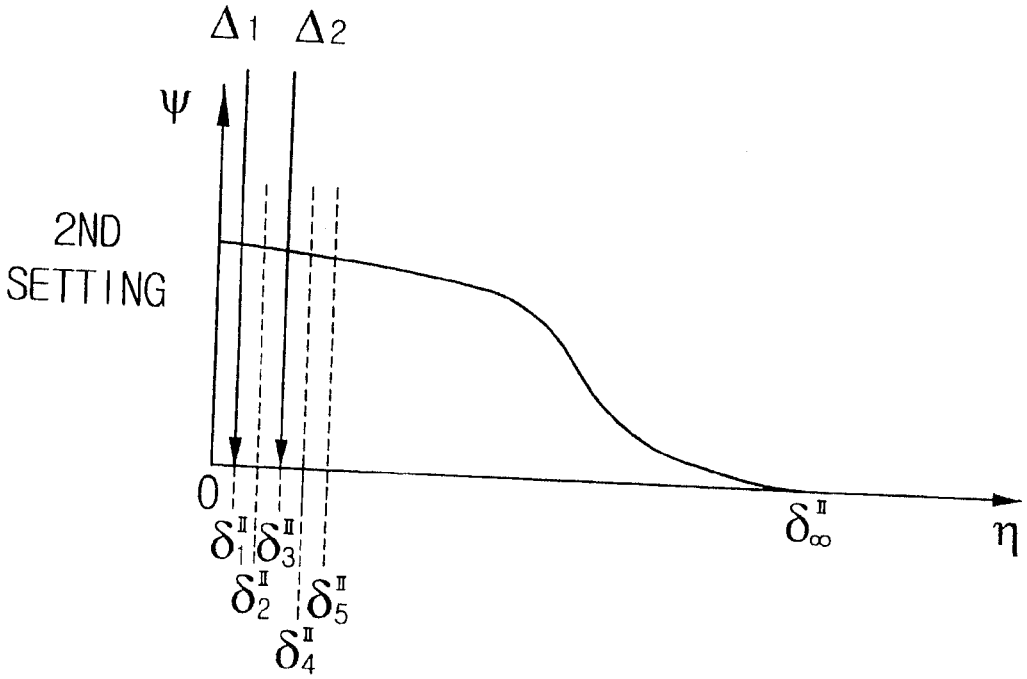
FIG. 17B is a graph showing multi-step correction in uniformly setting a reference time interval between the unit chips using a second setting.

If the vertical print error is not corrected by such set sections, as shown in FIG. 17A, the first time interval is reset as the maximum range of the error, and as shown in FIG. 17B, divided into denser time intervals. Since the uniform time intervals are narrowed within the preset time interval, the print error caused by the vertical misalignment can be corrected completely.

In the first setting, since $$\delta'=\delta'_\infty-\delta'_n=\delta'_n-\delta'_{n-1}=\ldots=\delta'_2-\delta'_1,$$

$$T^I = 2t^I_{n-1} = \cdots nt^I_1\left(t^I_1 = \frac{\delta^I_1}{U}\right).$$

In the second setting, since $$\delta^{II} = \frac{\delta^I}{n} = \delta^{II}_\infty - \delta^{II}_n = \cdots = \delta^{II}_2 - \delta^{II}_1,$$

$$t^{II}_n = 2t^{II}_{n-1} = \cdots = nt^{II}_1\left(t^{II}_1 = \frac{\delta^{II}_1}{U} = \frac{t^I_1}{n}\right).$$

Figure 18:
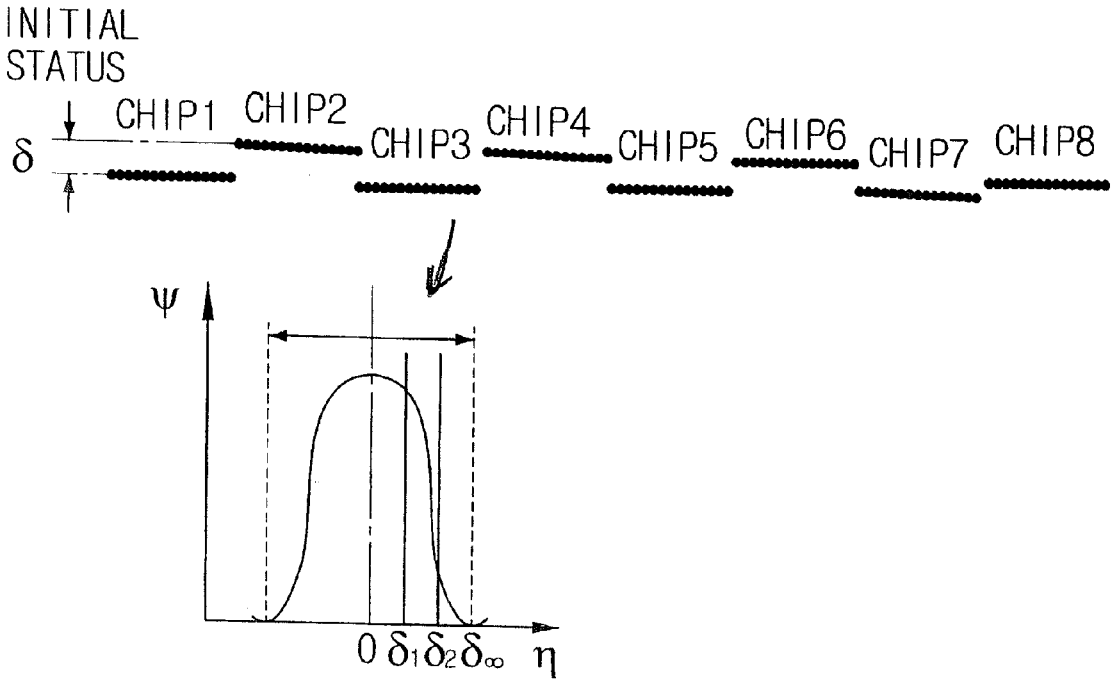
FIG. 18 is a graph showing the reference time interval between the unit chips being set in consideration of the probability distribution.

FIG. 18 illustrates the method of setting the time interval with reference to the region having the same probability. If the probability distribution is taken into account, then the time
intervals become denser toward the middle. Here, $$\int_0^{\delta_1}\Psi(\eta)\,d\eta = \int_{\delta_1}^{\delta_2}\Psi(\eta)\,d\eta = \int_{\delta_2}^{\delta_\infty}\Psi(\eta)\,d\eta,$$

and since $$t_1 < t_2 - t_1\left(t_1 = \frac{\delta_1}{U},\ t_2 = \frac{\delta_2}{U}\right).$$

Figure 19A:
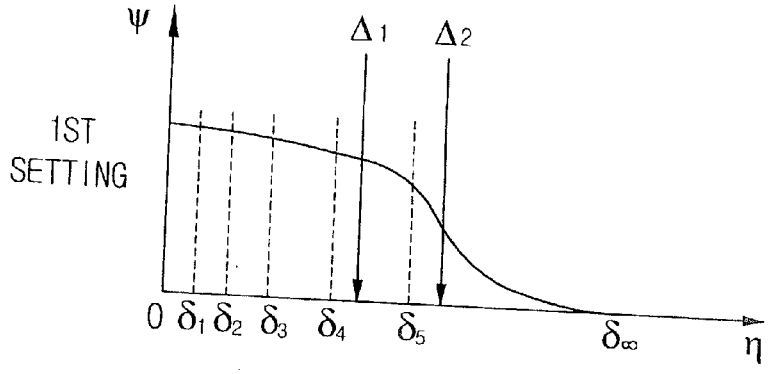
FIG. 19A is a graph showing a method of multi-step correction in setting the reference time interval between the unit chips in consideration of the probability distribution using a first setting.
Figure 19B:
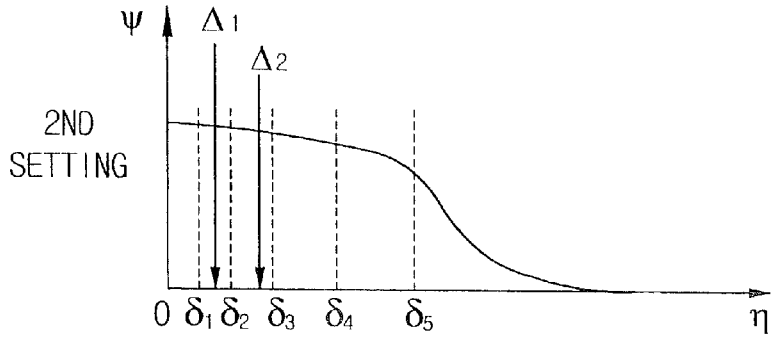
FIG. 19B is a graph showing a method of multi-step correction in setting the reference time interval between the unit chips in consideration of the probability distribution using a second setting.
Figure 19C:
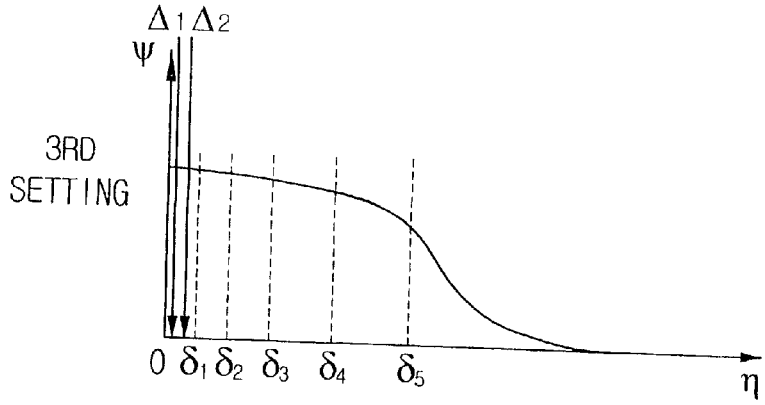
FIG. 19C is a graph showing a method of multi-step correction in setting the reference time interval between the unit chips in consideration of the probability distribution using a third setting.

If the vertical print error is not corrected by the above settings, as shown in FIGS. 19A–19C, vertical print error is re-corrected by using the time interval used previously.

In this case,
since $$\delta_\infty-\delta_n>\delta_n-\delta_{n-1}=\delta_{n-1}-\delta_{n-2}> \ldots >\delta_3-\delta_2>\delta_2-\delta_1,$$

in the first setting, $\delta_4<\Delta_1<\delta_5$, and $\delta_5<\Delta_2<\delta_\infty$, and in the second setting, $\delta_1<\Delta_1<\delta_2$, and $\delta_2<\Delta_2<\delta_3$.

In the third setting, $\delta_0<\Delta_1<\delta_1$, and $\delta_0<\Delta_2<\delta_1$, but these are negligible.

When setting the time intervals in consideration of the possibility distribution, one correction would reduce the amount of error caused by the vertical misalignment. Since the time intervals are divided more densely, the error is moved closer to the middle. Accordingly, with the same time intervals, a better correction is achieved.

Figure 20:
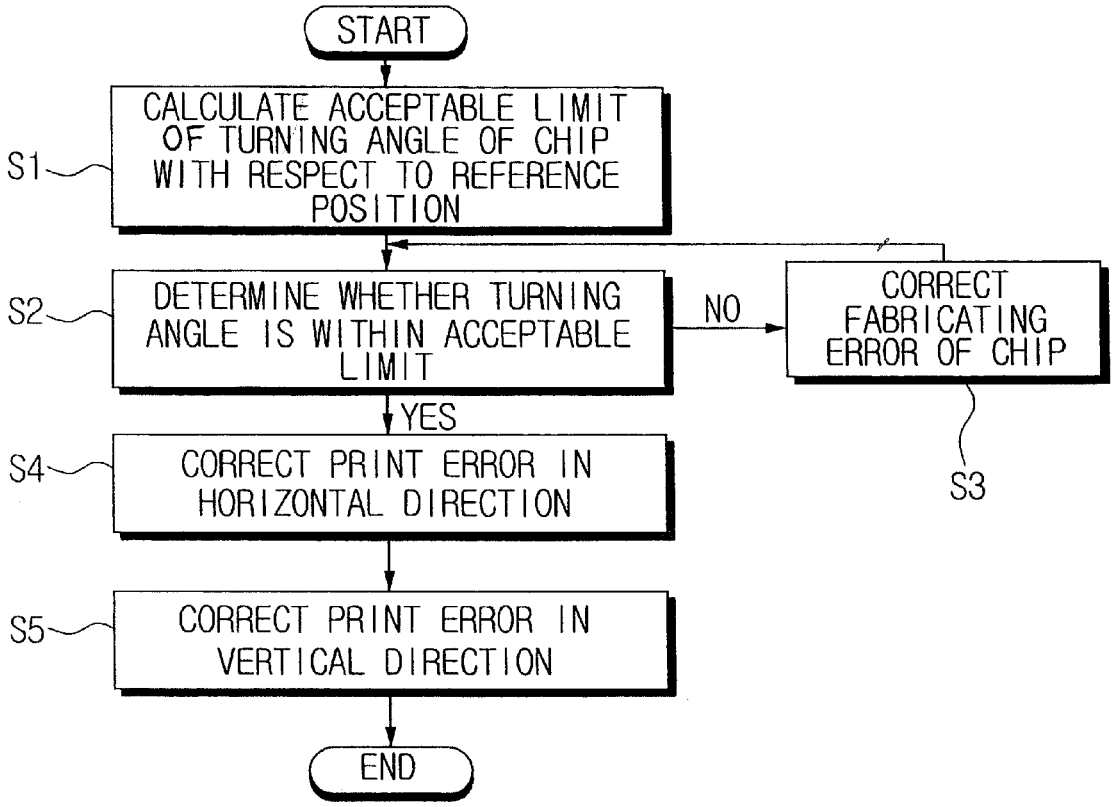
FIG. 20 is a flowchart showing a process of correcting the print error caused due to horizontal and vertical misalignment between the unit chips.

FIG. 20 is a flowchart illustrating the process of correcting the print error caused due to misalignment between the chips mounted on the array head of the inkjet printer. In correcting the print error, the acceptable limit for the rotation angle with respect to the reference position of the respective chip is calculated with formula 2, within the range that would not cause the white band to form on the printed image (step S1). Next, with the formula 3, it is determined whether the rotation angle of each chip is within the calculated acceptable limit (step S2). If the rotation angle is not within the acceptable limit, the machine error of the chip is corrected (step S3), and S2 is repeated If the rotation angle of each chip is within the acceptable limit, then a plurality of nozzles are added to at least one end of each chip, and based on a trial printing pattern, it is decided which of the plurality of nozzles to use. Accordingly, the horizontal print error by the horizontal misalignment is corrected (step S4). Next, based on the trial printing pattern, the voltage pulse application to the heater of the nozzle of the array head of the inkjet printer is variably determined with respect to the respective chips, to thereby adjust ink ejection time of the chips. By doing so, the vertical print error by the vertical misalignment between the chips is corrected, and the print error by the misalignment between the chips is also corrected (step S5).

As described above, according to the method of correcting the print error of the present invention, by using a trial printing pattern through a minimum number of steps, the print error caused by the misalignment between the chips can be corrected.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A method of correcting a print error caused due to a misalignment between chips mounted on an array head of an inkjet printer comprising nozzles, the method comprising calculating an acceptable limit of a rotation angle of the chips with respect to reference positions, within a range that does not cause a white band to form on a printed image;

determining whether the rotation angle of each chip is within the acceptable limit;

correcting a machine error of each chip if it is determined that the rotation angle of each chip is not within the acceptable limit;

if the rotation angle of each chip is within the acceptable limit, adding a plurality of nozzles on an end of each chip, determining which of the added nozzles to use based on a predetermined trial printing pattern, and correcting a print error in a horizontal direction that is caused due to a misalignment of the chips in the horizontal direction; and correcting a print error in a vertical direction that is caused due to a misalignment between the chips in the vertical direction by determining a reference time for a voltage pulse application to al heater disposed on one of the nozzles of the array head of the inkjet printer based on the trial printing pattern, by variably determining a voltage pulse application time, thereby adjusting a time interval for an ink ejection from respective chips.

2. The method of claim 1, wherein the determining of which of the added nozzles to use based on the trial printing pattern comprises determining which of the added nozzles to use so as not to cause the white band and a dark line to show in the trial printing pattern.

3. The method of claim 1, wherein the trial printing pattern is printed by sequentially operating the added nozzles from an inside to an outside of each chip, and simultaneously operating all of the added nozzles.

4. The method of claim 1, wherein the trial printing pattern is a strip that is formed by successively printing several lines with the added nozzles at an area where the chips are connected with each other.

5. The method of claim 1, wherein the nozzles are arranged in nozzle groups, each chip comprising a plurality of the nozzle groups, and the added nozzles are added to the end of each chip successively from an external end of an external nozzle group of each chip.

6. The method of claim 1, wherein the adjusting of the time interval comprises adjusting the time interval based on the trial printing pattern, the time interval being determined such that the trial printing pattern has no deviation of linking portions.

7. The method of claim 1, wherein the trial printing pattern comprises an image formed by printing lines one by one in a manner of a varying time interval for respective chips.

8. The method of claim 1, wherein the trial printing pattern is an image formed by repeatedly setting a first chip as a reference chip, setting a relative time interval between the first chip and a second chip adjacent to the first chip, and setting a relative time interval between the second chip with a third chip adjacent to the second chip, in order to set relative time intervals between the respective chips.

9. The method of claim 8, further comprising uniformly setting the relative time intervals within a possible print error range in the vertical direction.

10. The method of claim 9, further comprising re-setting the uniform relative time intervals within a maximum print error range in the vertical direction, respectively, and then uniformly dividing the relative time intervals into denser time intervals.

11. The method of claim 8, further comprising setting the relative time intervals within a possible print error range in the vertical direction with reference to a section of the respective relative time intervals that has an identical probability of error in the vertical direction.

12. The method of claim 11, further comprising resetting the relative time intervals within a maximum print error range in the vertical direction, and then dividing the relative time intervals into denser time intervals.

13. A method of correcting an error in a printer comprising chips having nozzles to form a printed image by ejecting ink, comprising:

determining whether a rotation angle of the chips with respect to a reference position is within an acceptable limit;

correcting a machine error of the chips if the rotation angle is not within the acceptable limit;

correcting a print error in a horizontal direction due to a misalignment of the chips in the horizontal direction, comprising:

adding a plurality of nozzles on an end of one of the chips, and;

determining which of the added nozzles to use based on a predetermined trial printing pattern; and correcting a print error in a vertical direction due to a misalignment of the chips in the vertical direction, comprising:

setting a time interval for the ejection of the ink from each of the chips based on the trial printing pattern.

14. The method of claim 13, wherein the acceptable limit comprises a range that does not cause a white band to form on the printed image.

15. The method of claim 13, wherein the setting of the time interval comprises:

selecting one of the chips as a reference chip;

setting an ink ejection time for each of the chips relative to the reference chip based on the time interval; and narrowing the time interval if the print error in the vertical direction is not corrected.

16. The method of claim 15, wherein the setting of the time interval is based on a probable print error in the vertical direction.

17. The method of claim 13, wherein the determining of which of the added nozzles to use comprises determining which of the added nozzles to use so as not to cause a white band and a dark line to show in the trial printing pattern.

18. The method of claim 13, wherein the acceptable limit is determined according to:

$$\theta_{\lim}[\deg] \approx \frac{(d - pel)}{W_{\max}} \times \frac{180}{\pi},$$

where pel is a length of the printed image divided by a number of dots of the printed image, $W_{max}$ is a distance between centers of adjacent ones of the nozzles, and d is a diameter of dots comprising the printed image.

* * * * *

UNITED STATES PATENT AND TRADEMARK OFFICE

CERTIFICATE OF CORRECTION

PATENT NO. : 6,412,903 B1
DATED : July 2, 2002
INVENTOR(S) : Sung-hee Lee et al.

It is certified that error appears in the above-identified patent and that said Letters Patent is hereby corrected as shown below:

Title page,
Item [75], Inventors, change "Kvu-ho" to -- Kyu-ho --.

Column 8,
Line 24, after "comprising" insert -- : --.

Signed and Sealed this

Nineteenth Day of November, 2002

*Attest:*

*Attesting Officer*

JAMES E. ROGAN
*Director of the United States Patent and Trademark Office*